US006830509B2

(12) United States Patent
Perkitny

(10) Patent No.: US 6,830,509 B2
(45) Date of Patent: Dec. 14, 2004

(54) COIN BANK

(75) Inventor: Jerzy Perkitny, Lakewood, OH (US)

(73) Assignee: Mag-Nif Incorporated, Mentor, OH (US)

( * ) Notice: Subject to any disclaimer, the term of this patent is extended or adjusted under 35 U.S.C. 154(b) by 0 days.

(21) Appl. No.: 10/633,931

(22) Filed: Aug. 4, 2003

(65) Prior Publication Data

US 2004/0029517 A1 Feb. 12, 2004

Related U.S. Application Data

(63) Continuation of application No. 09/879,732, filed on Jun. 12, 2001, now Pat. No. 6,638,157.

(51) Int. Cl.[7] ..... G07D 3/04

(52) U.S. Cl. ..... 453/13; 453/12; 453/61; 453/62; 194/350

(58) Field of Search ..... 453/5, 9, 11–13, 453/61, 62; 194/350

(56) References Cited

U.S. PATENT DOCUMENTS

| | | | | | |
|---|---|---|---|---|---|
| 326,866 | A | * | 9/1885 | Harcourt | 453/8 |
| 1,346,457 | A | * | 7/1920 | Leja | 453/5 |
| 3,227,363 | A | * | 1/1966 | Hecker et al. | 235/7 R |
| 3,242,931 | A | | 3/1966 | Wandrey | |
| 3,265,077 | A | * | 8/1966 | Kirkpatrick | 453/60 |
| 4,095,607 | A | | 6/1978 | Newton et al. | |
| 4,396,029 | A | | 8/1983 | Anderson | |
| 4,511,341 | A | | 4/1985 | Spirk, Jr. et al. | |
| 4,593,709 | A | | 6/1986 | Duplessy | |
| 4,606,361 | A | * | 8/1986 | Nottingham et al. | 453/3 |
| 4,987,990 | A | | 1/1991 | Perkitny | |
| 4,995,848 | A | | 2/1991 | Goh | |
| 5,397,264 | A | * | 3/1995 | Gross | 453/37 |
| 5,474,496 | A | | 12/1995 | Perkitny | |
| 5,722,882 | A | * | 3/1998 | Kashiwagi et al. | 453/11 |
| 5,827,117 | A | | 10/1998 | Naas | |
| 5,902,178 | A | | 5/1999 | Perkitny | |
| 5,976,006 | A | | 11/1999 | Snyder | |
| 6,099,401 | A | | 8/2000 | Perkitny | |
| 6,165,063 | A | | 12/2000 | Perkitny | |
| 6,165,064 | A | * | 12/2000 | Aurelius et al. | 453/18 |
| 6,210,264 | B1 | | 4/2001 | Richardson et al. | |
| 6,524,179 | B2 | | 2/2003 | Perkitny et al. | |
| 6,638,157 | B2 | * | 10/2003 | Perkitny | 453/13 |

FOREIGN PATENT DOCUMENTS

| | | |
|---|---|---|
| GB | 2130779 | 6/1984 |
| GB | 2138192 | 10/1984 |

OTHER PUBLICATIONS

Mag–Nif makes it in the U.S.A.! 1999 Brochure, front and back cover pages and pp. 1–16.

* cited by examiner

*Primary Examiner*—Donald P. Walsh
*Assistant Examiner*—Jeffrey A. Shapiro
(74) *Attorney, Agent, or Firm*—Fay, Sharpe, Fagan, Minnich & McKee, LLP

(57) ABSTRACT

A coin bank includes a housing having a coin receiving area for receiving unsorted coins, a coin sorting area for sorting the unsorted coins and a coin storage area for storing sorted coins. The coin storage area includes a drawer slidably mounted in the housing and a coin tube support movably mounted in the drawer between a first position, when the drawer is fully retracted into the housing and a second position, when the drawer is fully extended from the housing. A plurality of coin tubes is mounted in the coin tube support for holding sorted coins. The plurality of coin tubes is inclined in relation to a vertical axis for receiving sorted coins when the drawer is in a retracted position. A reservoir is located directly above each of the coin tubes for holding at least one additional coin above a stack of coins completely filling the coin tube.

30 Claims, 16 Drawing Sheets

COIN BANK

This application is a continuation application claim priority from U.S. application Ser. No. 09/879,732 filed Jun. 12, 2001, now U.S. Pat. No. 6,638,157.

BACKGROUND OF THE INVENTION

The present invention relates to a coin bank. More particularly, the present invention relates to a coin back which separates, sorts and stores five different denominations of coins.

Coin sorting devices are generally known. A user places one or more coins in a hopper or similar coin receiving location. A coin separating mechanism separates the coins and moves them, hopefully one at a time, into a coin sorting mechanism. The coin sorting mechanism classifies the coins by their diameter. Coins of a particular diameter, and consequently of a particular denomination, are directed into the appropriate one of a plurality of sorted coin storage containers. The containers are accessible in order that the sorted coins can be removed.

Coin separating mechanisms employing rotating coin separator plates are known. One such separator plate is in the form of a disk having four U-shaped notches formed in its periphery. Each notch is sized to be larger in width than the largest coin which is to be sorted by a coin sorter. The separator plate is mounted on a planar base of the receiver, the base being fixed to an upper housing at a slope of approximately 45° from the horizontal. Coins tend to come to rest in the lowermost portion of the receiver with their faces contacting the separator plate or the base. When the separator plate is rotated, it will engage a coin with the edge of one of its notches and carry the coin upward to an opening formed in the base where the coin will fall through into an upper portion of a coin ramp leading to a sorting ramp. The ramp has apertures of increasing size through which the coins fall into sorted coin containers.

However, this known coin separating mechanism is not capable of sorting coins of five different denominations. Moreover, the known mechanism does not employ a drawer in which the coin containers are held in order to allow an easy removal of the coin containers from the housing of the coin bank. Another deficiency in known coin sorters is that the coins being sorted bounce or wobble, especially just upstream of the sorted coin containers. This reduces the coin counting consistency and accuracy of the known banks.

Accordingly, it is desirable to develop a new and improved five coin bank which would overcome the foregoing deficiencies and others, as well as providing better and more advantageous overall results.

BRIEF SUMMARY OF THE INVENTION

According to the present invention, a coin bank is provided. More particularly, in accordance with this aspect of the invention, the coin bank comprises a housing including a coin receiving area for receiving unsorted coins and a coin sorting assembly mounted in the housing and located beneath the coin receiving area. A drawer is slidably mounted in the housing beneath the coin sorting assembly. A coin tube support is movably mounted in the drawer. A plurality of coin tubes is mounted in the coin tube support for holding sorted coins. The plurality of coin tubes is inclined in relation to a vertical axis for receiving sorted coins when the drawer is in a retracted position in relation to the housing and is approximately upright for removing at least one of the plurality of coin tubes when the drawer is in an extended position in relation to the housing.

In accordance with another aspect of the present invention, a coin bank is provided.

More particularly in accordance with this aspect of the invention, the coin bank comprises a housing including a coin receiving area for receiving unsorted coins, a coin sorting area for sorting the unsorted coins, and a coin storage area for storing sorted coins. The coin storage area comprises a coin tube support, and at least one coin tube mounted in the coin tube support for holding a selected number of sorted coins. A reservoir is located directly above the at least one coin tube for holding at least one additional coin atop a stack of coins held in the at least one coin tube and completely filling same.

In accordance with still another aspect of the invention, a coin bank is provided.

More particularly, in accordance with this aspect of the invention, the coin bank comprises a housing including a coin receiving area for receiving unsorted coins, a coin sorting area for sorting the unsorted coins and a coin storage area for storing sorted coins. The coin storage area comprises a coin slide area located beneath the coin sorting area. The coin slide area has a sliding surface with an upper end and a lower end. An aperture is located in the sliding surface lower end. A depending wall extends away from the sliding surface lower end and at least partially surrounds the sliding surface aperture. An aperture extends through the depending wall.

In accordance with a further aspect of the present invention, a method of sorting and storing coins is provided.

In accordance with this aspect of the invention, the method comprises the steps of conveying unsorted coins to a coin container and sorting the coins. A set of coin containers beneath the coin sorter is oriented at an acute angle in relation to a vertical axis, and coins are passed into the set of coin containers. At least one of the coin containers is filled to create a completely filled container. At least one additional coin is stored in a reservoir located immediately above a stack of coins held in the completely filled container.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1A:
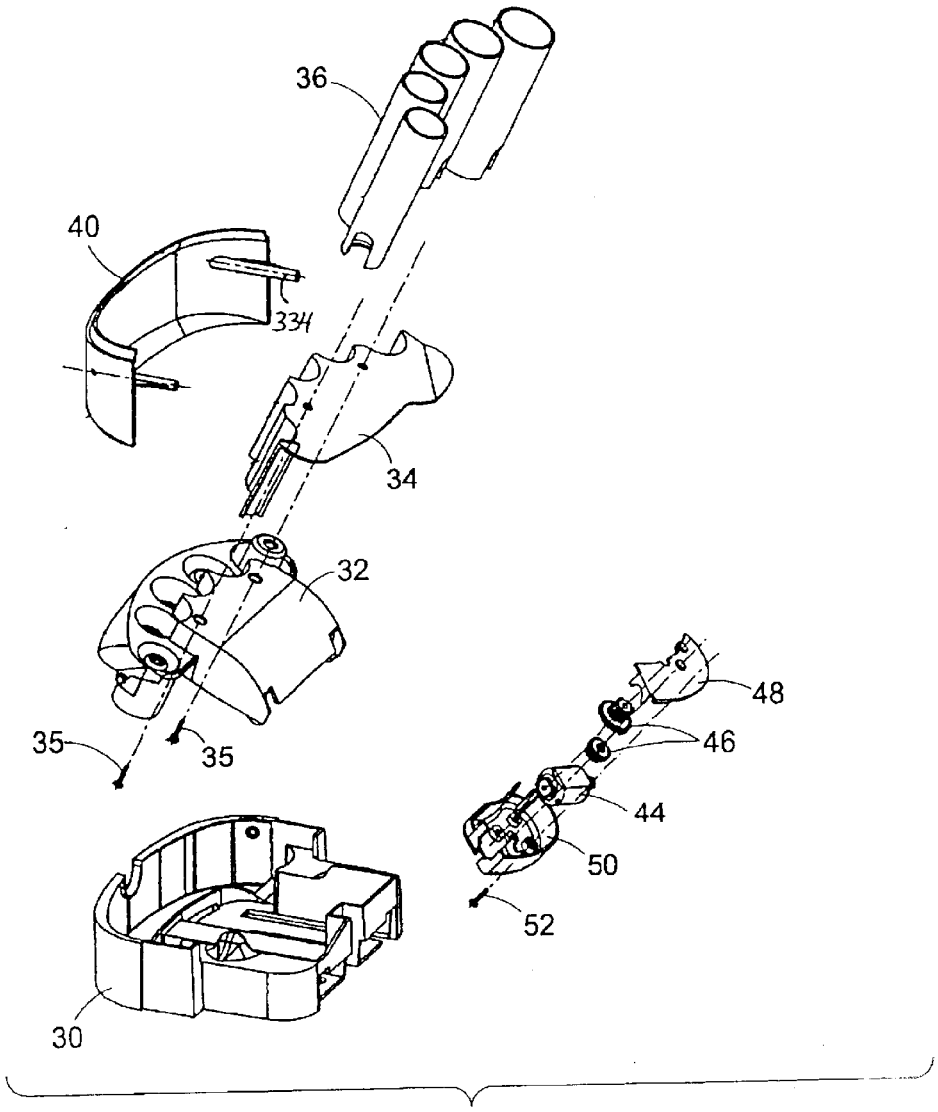
FIG. 1A is an exploded perspective view of a first portion of a coin bank according to the present invention.

Referring now to the drawings, wherein the showings are for purposes of illustrating a preferred embodiment of the invention only and not for purposes of limiting same, the Figures show a coin bank in accordance with the preferred embodiment of the present invention.

Figure 1B:
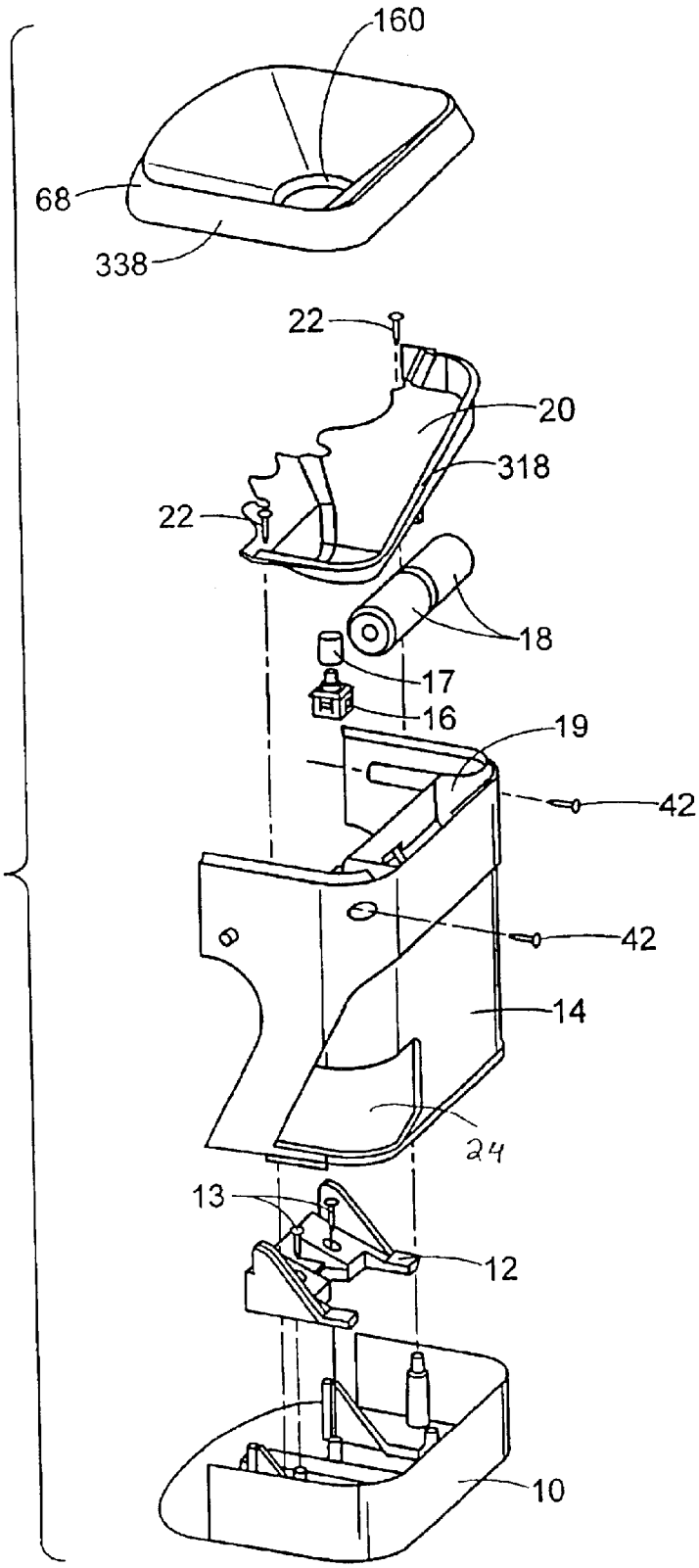
FIG. 1B is an exploded perspective view of a second portion of a coin bank according to the present invention.

With reference now to FIG. 1B, the coin bank, according to the present invention, comprises a base 10 on which is positioned a ramp 12. The ramp is preferably secured to the base by suitable fasteners 13. Mounted on the base 10 is a back housing 14. Secured to the back housing is a switch 16 on which is mounted an activation button 17. One or more batteries 18 can be mounted in a battery housing compartment 19 formed in the back housing 14. A coin overflow compartment 20 can be mounted to the base 10 via suitable fasteners 22. An overflow coin removal opening 24 is located in the back housing 14.

With reference now also to FIG. 1A, slidably mounted in the base 10 is a drawer 30. Housed in the drawer 30 is a coin tube base 32 having a rear support wall 34 which is secured to the coin tube base 32 by suitable fasteners 35. Several coin tubes 36, one for each denomination of coins meant to be sorted, are selectively mounted on the coin tube base 32 and are supported by the support wall 34, which has suitably shaped indentations for that purpose. A front wall 40 of the apparatus is mounted to the back housing 14 by suitable fasteners 42 (FIG. 1B). The front wall 40 is located above the drawer 30 and is spaced therefrom by at least the length of the coin tubes 36. A motor 44 of the apparatus has an output shaft (not visible in FIG. 1A) connected to a gear train having a plurality of gears 46. The motor 44 and the gears 46 are mounted in a housing assembly having an upper housing portion 48 and a lower housing portion 50, which are secured together by a fastener 52.

Figure 1C:
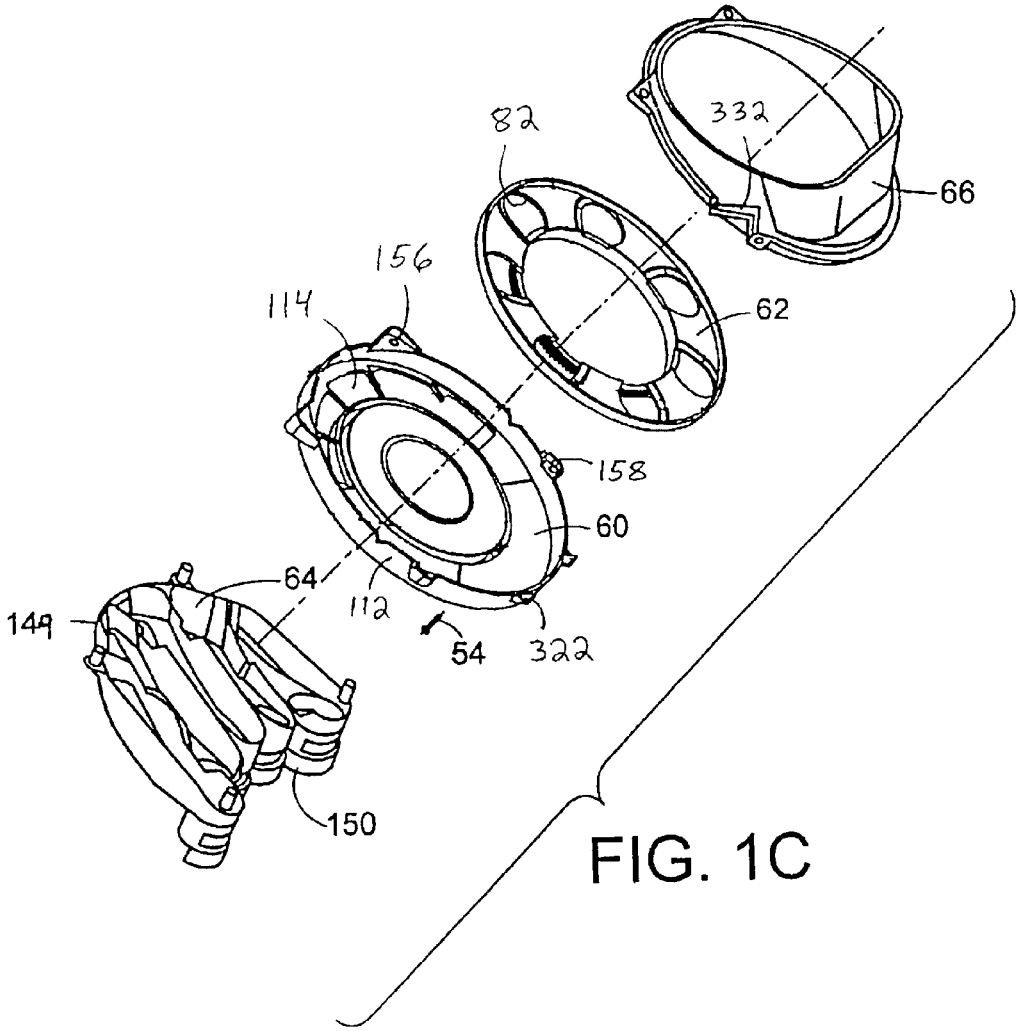
FIG. 1C is an exploded perspective view of a third portion of a coin bank according to the present invention.
Figure 4:
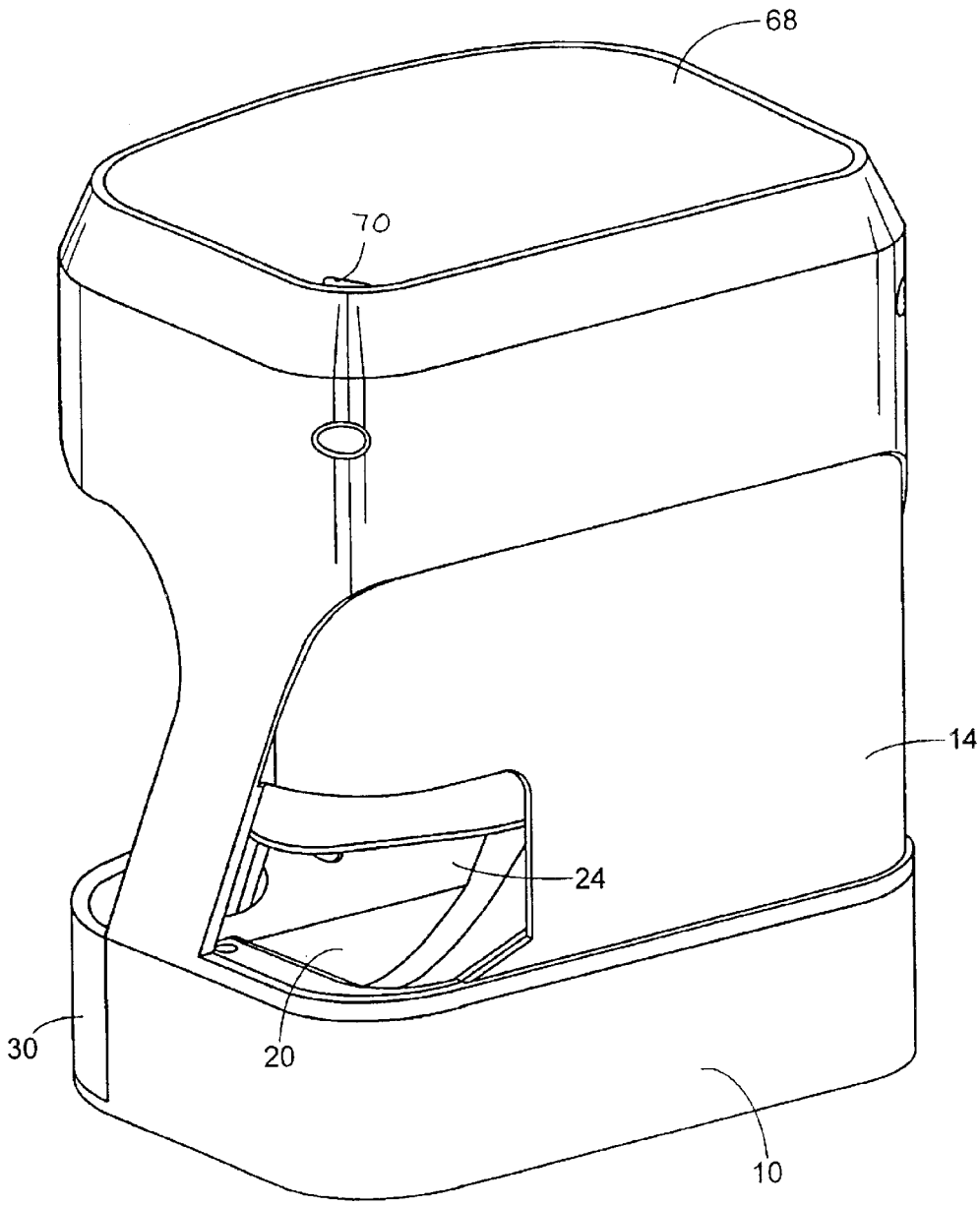
FIG. 4 is a perspective view of the coin bank of FIG. 2 taken from a right rear thereof.

With reference now to FIG. 1C, suitable fasteners 54 are employed to mount a wheel housing 60 in place in the apparatus. The motor housing halves 48 and 50 are secured by the fastener 52 to a lower face of the wheel housing 60. Mounted on the wheel housing 60 is a separating wheel 62. Positioned below the wheel housing 60 and mounted thereto is a coin slide 64. A cover or hopper 66 is mounted above the wheel housing 60. With reference again to FIG. 1B, a funnel 68 constitutes a top portion of the coin bank. The funnel is selectively removable from the coin bank to provide access to the separating wheel 62. The button 17 protrudes through an opening 70 (FIG. 4) in the funnel for access thereto.

A more detailed description of the separating wheel 62 and the wheel housing 60, which together comprise a coin separating and sorting structure for the instant coin bank, can be found in copending application Ser. No. 09/780,826, filed on Feb. 9, 2001. The subject matter of that application is incorporated hereinto by reference in its entirety.

Figure 9:
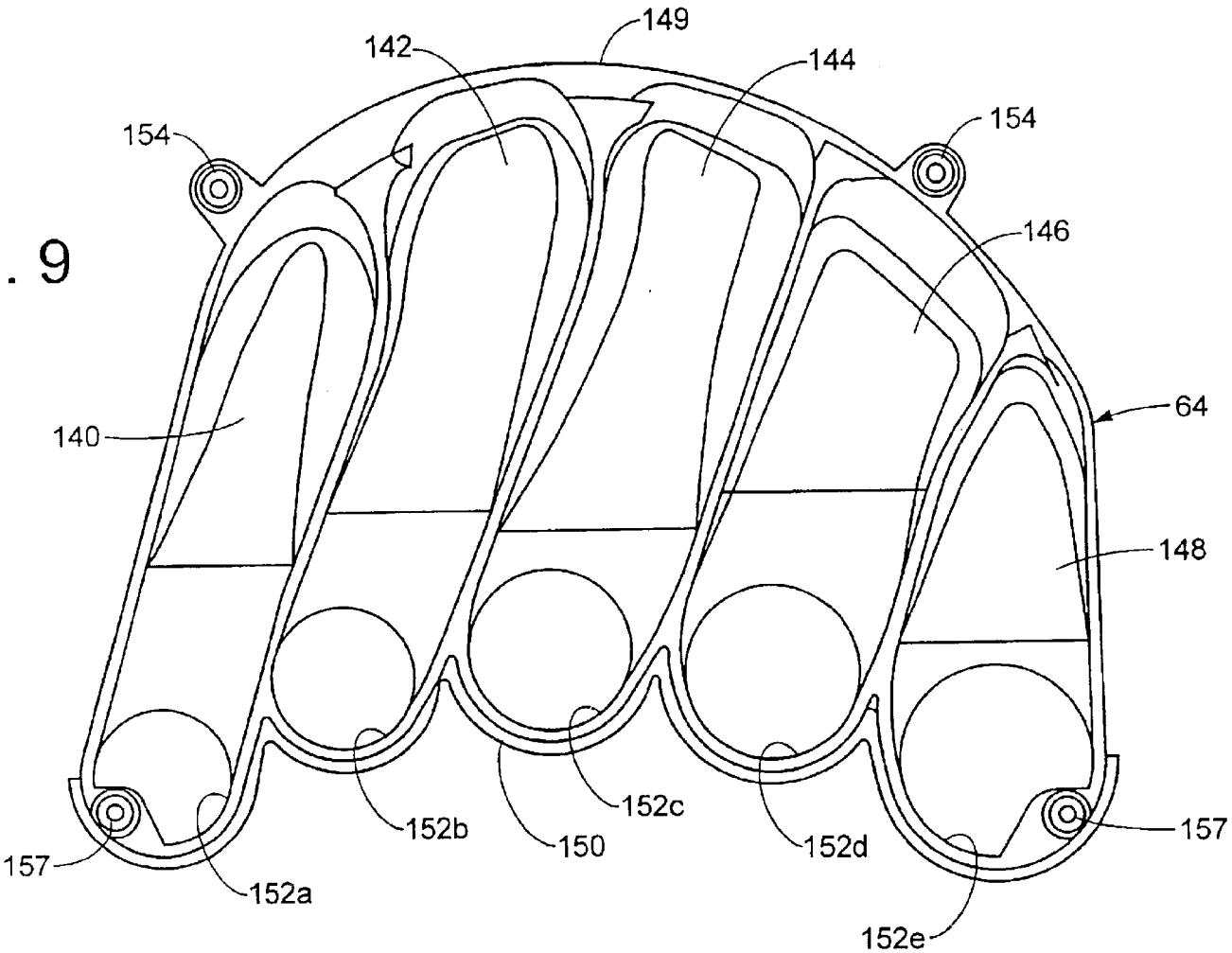
FIG. 9 is an enlarged top plan view of the coin slide of FIG. 1B.

With reference now to FIG. 9, the coin slide 64 is provided with five coin sliding surfaces 140, 142, 144, 146 and 148. These coin sliding surfaces are meant to accommodate five different diameters of coins. If United States coinage is being sorted, the coins are the dime, penny, nickel, quarter and dollar coins. When such coins are sorted, the dime coin will slide down sliding surface 140 with the penny sliding down surface 142, the nickel down surface 144, the quarter down surface 146 and the dollar down surface 148. Coins are fed to these five sliding surfaces from varying width openings 114 (FIG. 1C) in the wheel housing 60 as explained in greater detail in the copending application referenced above. The coins are delivered to the openings in the wheel housing via apertures 82 (FIG. 1C) of the separator wheel 62 as it rotates.

The coin slide slopes from an upper end 149 to a lower end 150. Positioned at the lower end of each of the coin sliding surfaces 140–148 is a respective opening 152*a*–152*e*. It should be apparent that the several openings 152*a*–152*e* are of different diameters, with the aperture 152*a* having the smallest diameter and the aperture 152*e*having the largest diameter. The diameters of the apertures 152*a*–152*e* are each slightly larger than the diameter of the coin meant to be accommodated in a respective one of the slides. The diameters of the apertures 152*a*–152*e* correspond with the widths of the openings 114 (FIG. 1C) in the wheel housing 60.

A pair of spaced ears 154 are located on the upper end 149 of the coin slide 64. These ears 154 cooperate with suitable ears 156 (FIG. 1C) extending away from a skirt 112 of the wheel housing 60. Similarly, spaced posts 157 extend away from the lower end of the coin slide adjacent the smallest and largest diameter apertures 152*a* and 152*e*. The posts 157 cooperate with ears 158 (FIG. 1C) extending away from the skirt 112 of the wheel housing 60. Suitable fasteners, not illustrated, enable the coin slide 64 to be mounted beneath the wheel housing 60 via the cooperating ears 154 and 156 and posts 157 and ears 158. Note that the center portion of the coin slide lower end 150 is somewhat recessed in relation to the two wings thereof to form a somewhat crescent-shaped lower end 150. This shape allows the motor housing 48, 50 to be secured to the wheel housing while not interfering with the coin slide 64.

Figure 8:
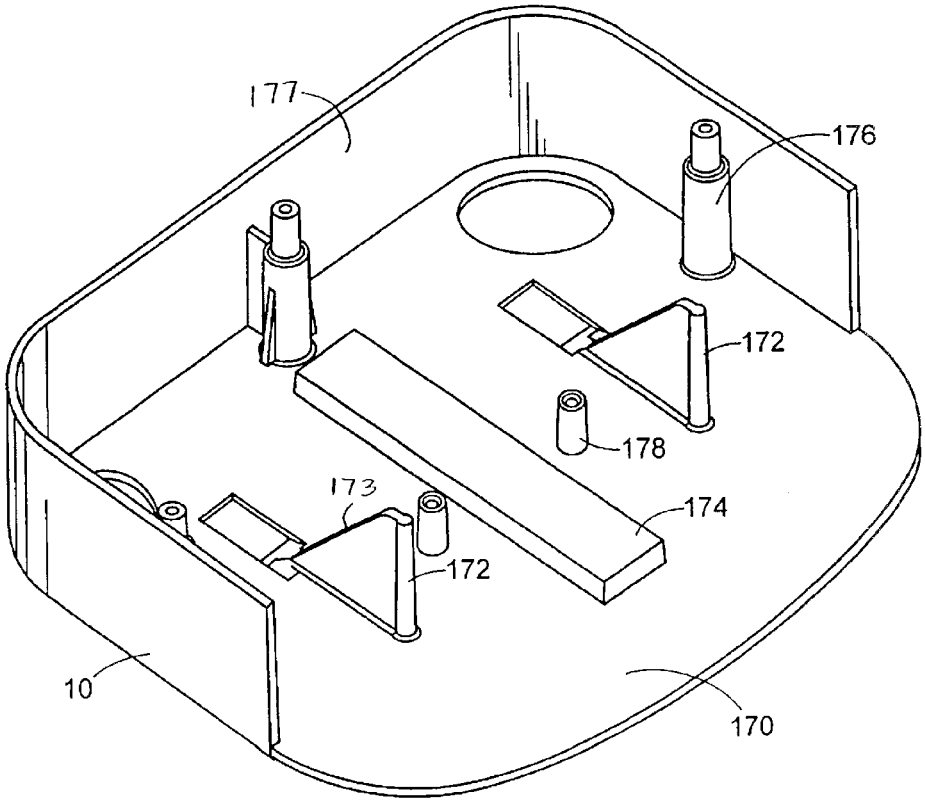
FIG. 8 is an enlarged perspective view of a base of the coin bank of FIG. 2.

With reference now to FIG. 8, the base 10 of the present invention comprises a bottom wall 170. Extending upwardly from the bottom wall are a pair of triangularly shaped flanges 172. These each have an edge 173 which serves as a roller contact surface. Also provided is a centrally located drawer guide 174. A plurality of peripheral stems 176 project upwardly from the bottom wall 170, adjacent a skirt 177 extending upwardly from the bottom wall 170. Also provided are a pair of central stems 178.

Figure 7A:
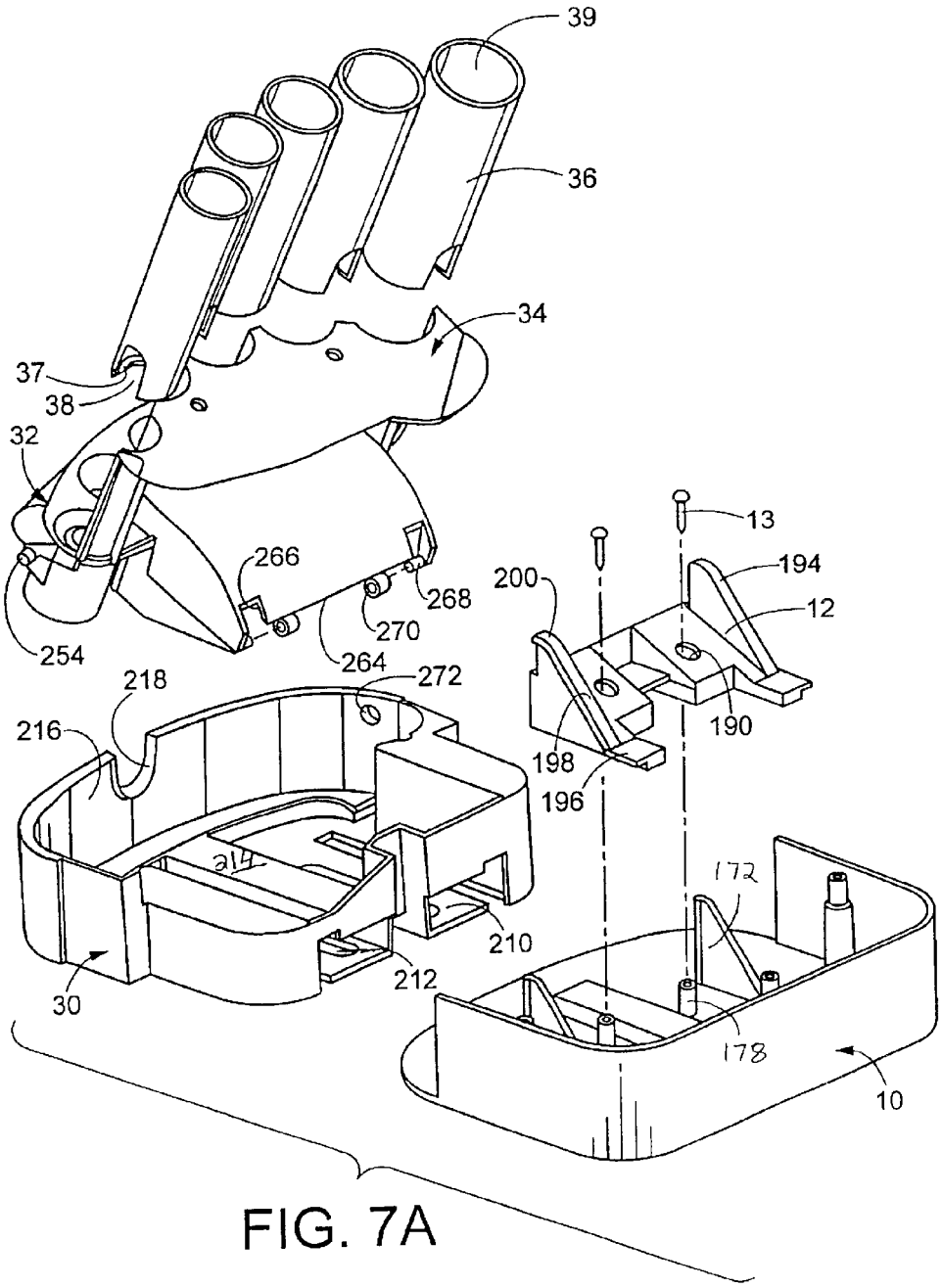
FIG. 7A is an exploded perspective view of the drawer of FIG. 2.

With reference now to FIG. 7A, the ramp 12 includes a pair of recessed areas 190. These are aligned with the central posts 178 to correctly position the ramp 12 on the base. The fasteners 13 secure the ramp 12 to the base 10. The ramp 12 includes a pair of spaced overhangs 194 which are aligned with the flanges 172 of the base and overlie the flanges. Each of the overhangs 194 comprises a first substantially horizontal section 196, a second upwardly angled section 198 and a third curved section 200. The overhang sections track the shape of the flanges 172 to maintain a relatively constant distance therebetween, as best seen in FIG. 7B.

With continued reference to FIG. 7A, the drawer 30 comprises a base wall 210 in which are provided a pair of spaced slots 212. The slots are aligned with and accommodate the flanges 172 and overhangs 194 of the base 10 and ramp 12. The slots 212 are long enough so that while the drawer reciprocates in relation to the base 10, the ramp 12 is stationary, along with the base 10, and the drawer simply slides in relation to these two elements. To this end, the drawer is provided with a raised guide surface 214 which is aligned with and overlies the drawer guide 174 of the base 10. The drawer also comprises a front wall 216 in which a centrally positioned finger recess 218 is located.

Figure 10:
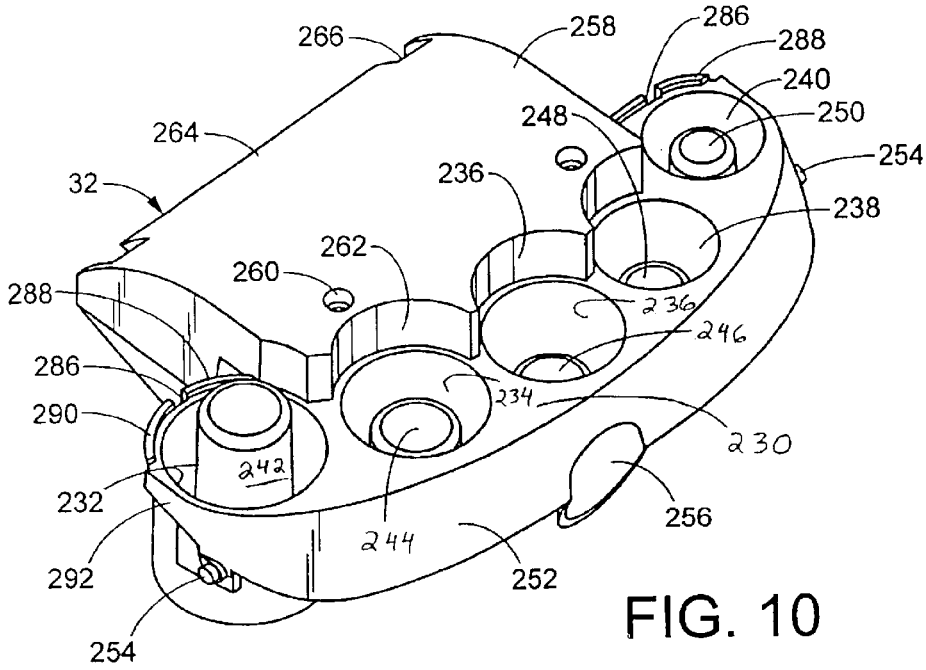
FIG. 10 is an enlarged perspective view of a coin tube base of the coin bank of FIG. 1A.

With reference now to FIG. 10, the coin tube base 32 comprises a bottom wall 230 in which are provided a plurality of recessed areas, namely, first, second, third, fourth and fifth recessed areas 232–240. Each of the recessed areas has projecting upwardly from a bottom wall thereof a respective centrally located post 242–250. The posts are of differing heights to allow a desired number of coins to be held in each of the coin tubes 36. A skirt 252 depends from a front edge of the bottom wall 230. A pair of stems 254 project away from opposing sides of the skirt. Centrally positioned in the skirt is a depressed area 256. Extending upwardly from the bottom wall 230 and positioned rearwardly of the recessed areas 232–240 is a plateau 258. Located in the plateau are a pair of recessed areas 260. The plateau also includes a scalloped front edge 262 which is meant to accommodate portions of the several coin tubes 36. A rear edge 264 of the bottom wall 230 includes a pair of cut-outs 266.

Figure 5:
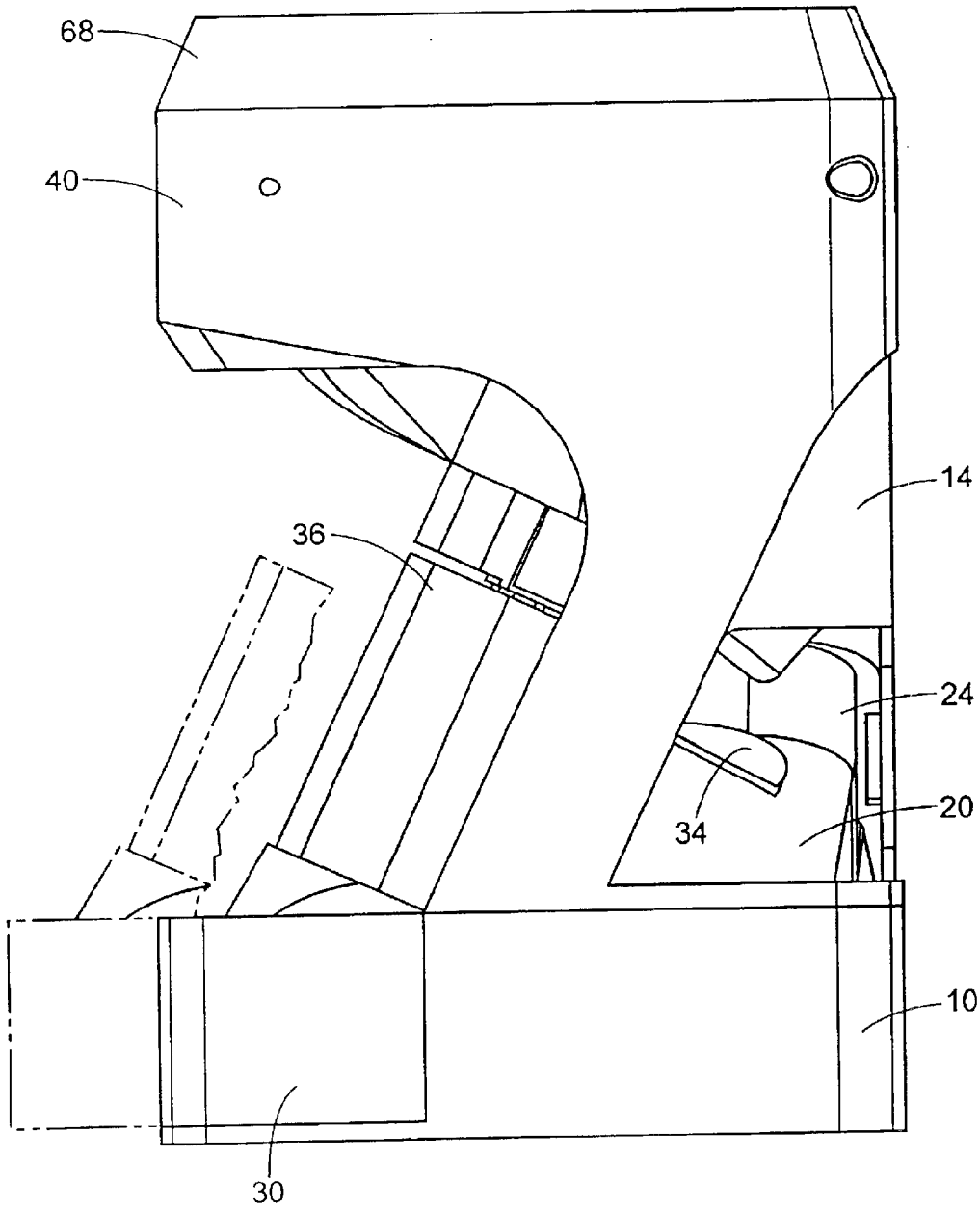
FIG. 5 is a side-elevational view of the coin bank of FIG. 2 with the drawer shown in a retracted and in a partially extended position.
Figure 6:
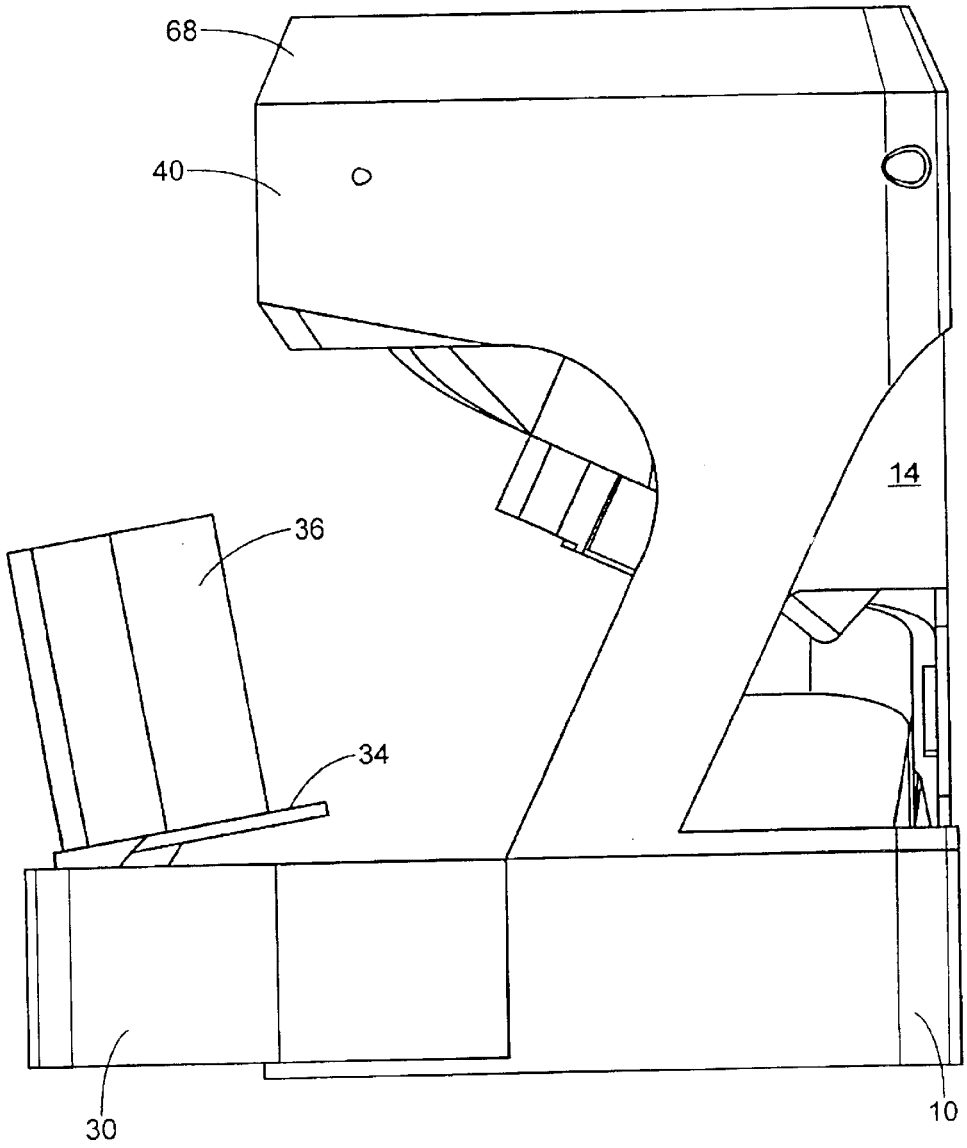
FIG. 6 is a side-elevational view of the coin bank of FIG. 2 with the drawer shown in a fully extended position.
Figure 7B:
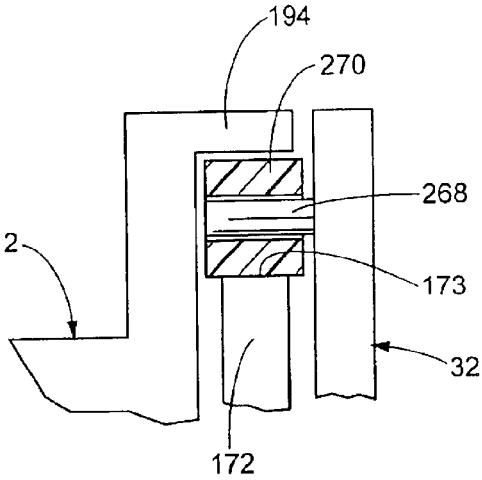
FIG. 7B is an enlarged assembled view of a portion of the drawer of FIG. 7A.

As best illustrated in FIG. 7B, an axle 268 extends into each cut-out. A roller 270 is mounted on each of the axles 268. The rollers 272 are trapped between edges 173 of the flanges 172 and the overhangs 194 of the ramp 12 when the coin tube base 32 is mounted in the drawer 30. As the drawer 30 is extended and retracted, the coin tube base 32 pivots in relation to the drawer, as shown in FIGS. 5 and 6. To this end, the stems 254 on the coin tube base 32 are mounted in sockets 272 (FIG. 7A) defined on the inner surface of the drawer front wall 216. A forward tipping of the coin tube base 32 is limited by the overhangs 194. The coin tube base is guided in its tipping motion by the rollers 272 moving between the flange edges 173 and the overhangs 194.

Figure 11:
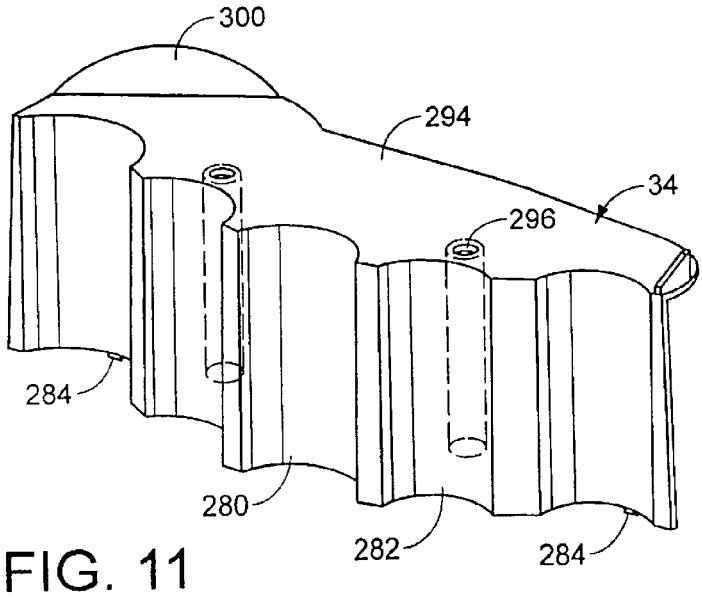
FIG. 11 is an enlarged perspective view of a support wall of the coin bank of FIG. 1A.

With reference now to FIG. 11, the support wall 34 includes a scalloped front surface 280 which is meant to accommodate the varying diameters of the several coin tubes 36. A bottom edge 282 of the support wall 280 includes a pair of tabs 284. The tabs 284 mount in slots 286 in flanges 288 positioned on a rear surface 290 of each wing 292 of the coin tube base 32, as shown in FIG. 10. The support wall 280 also includes a top wall 294. Positioned in the top wall are a pair of apertures 296 which lead to posts 298. The posts 298 mount into the recessed areas 260 of the coin tube base plateau 258. The fasteners 35 (FIG. 1A) secure the posts 298 of the support wall 34 to the coin tube base 32. A raised section 300 is located at one end of the top wall 294.

Figure 12:
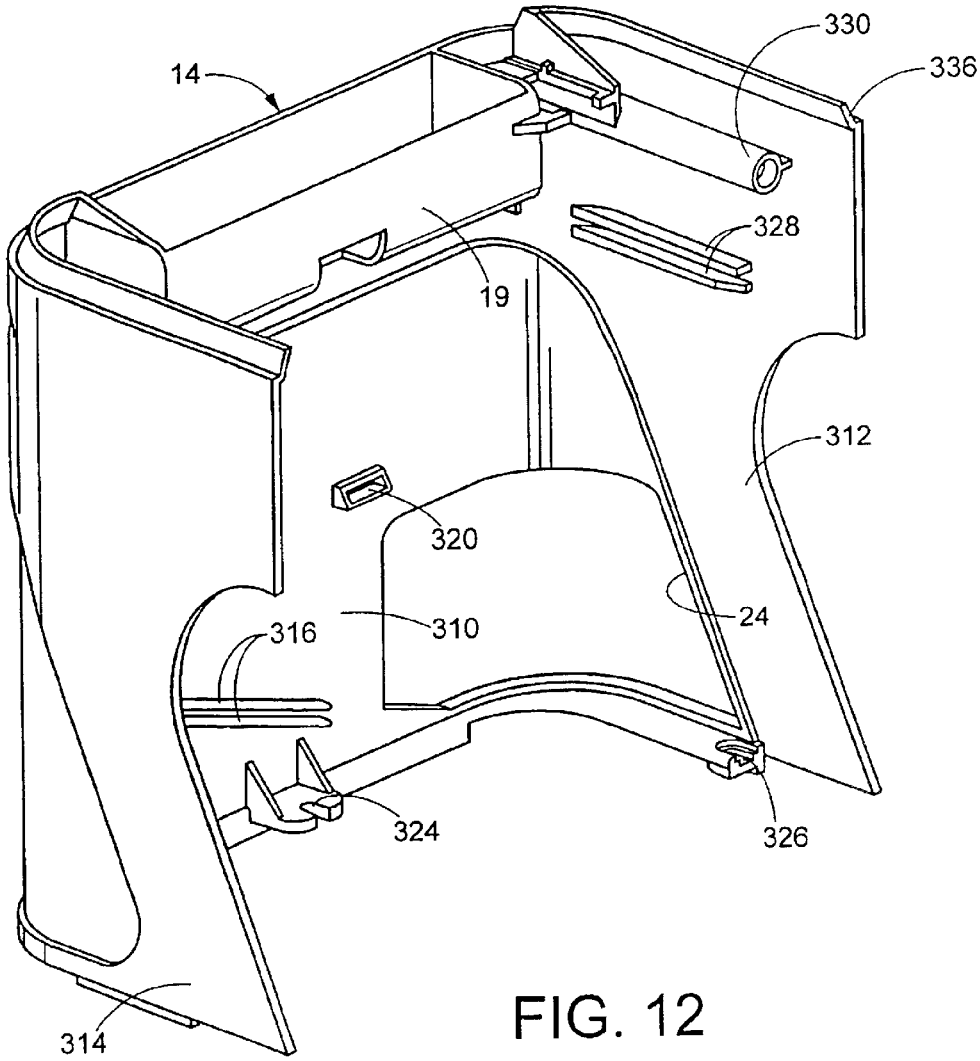
FIG. 12 is an enlarged perspective view of a back housing of the coin bank of FIG. 1B.

With reference now to FIG. 12, the back housing 14 comprises a rear wall 310 and first and second side walls 312 and 314. Positioning ribs 316 are located on the rear wall for mounting a rear edge 318 of the overflow container 20 illustrated in FIG. 1B. Also provided on the rear wall are a pair of sockets 320 (only one of which is visible) for accommodating a pair of tabs 322 (FIG. 1C) on the wheel housing 60. Extending from a lower edge of the back housing rear wall is a fastener mount 324. Positioned adjacent a top end of the back housing rear wall 310 is the battery compartment 19. The coin overflow removal opening 24 is provided in both the rear wall 310 and the first side wall 312. Also located on the first side wall 312 is a fastener mount 326 and a pair of spaced positioning ribs 328 as well as a tubular socket 330. The positioning ribs hold tabs 332 (FIG. 1C) of the cover 66 between them. The socket 330 accommodates a stem 334 extending from the front wall 40. The first side wall 312 also includes a tapered top edge 336 which accommodates a bottom edge 338 of the funnel 68 illustrated in FIG. 1B. It should be apparent that the second side wall 314 has a design similar to the first side wall with the exception that there is no coin overflow opening, such as opening 24, located in the second side wall.

The separating wheel 62, the wheel housing 60, as well as the coin slide 64, coin tube base 32, support wall 34 and drawer 30 can all be manufactured from suitable conventional plastic material. Alternatively, the separating wheel and the wheel housing can be formed of a conventional metal. Whatever material is used should be resistant to scratching by the coins being separated and sorted. Similarly, the base 10, back housing 14 and front wall 40 as well as the funnel 68 and cover 66 can also be manufactured from a suitable conventional plastic or metal material.

The operation of the coin sorter according to the present invention is as follows: as coins are dropped into the funnel 68, they will fall through an aperture 160 at the center thereof and fall through the hopper 66 and onto the sorting wheel 62. As the motor 44 rotates the gears 46 in the gear train, the gears will cause the separating wheel 62 to rotate in a clockwise direction. The coins, thus being held in the cover or hopper 66, are then moved and fall into respective ones of a plurality of apertures 82 in the separating wheel 62. As an aperture of the wheel travels over the several increasingly larger sized apertures 114 in the wheel housing 60, each coin being held will fall through the correctly sized opening and fall onto the associated one of the coin sliding surfaces 140–148. The coins will then travel down the slide and fall through the associated ones of the apertures 152*a*–152*e*. The coins will then fall into a respective one of the coin containers 36 and be stacked therein.

After the coin sorting process is done, and when it is desired to remove the coins which have been sorted, the drawer 30 is pulled forwardly out of its retracted position and into its extended position. During this process, the coin tubes will be moved away from an angled orientation to an approximately upright orientation as may be seen by comparing FIG. 5, in which the coin tubes assume an acute angle in relation to a vertical axis, to FIG. 6. During the first part of this motion, the coin tubes will remain in their angled orientation as the rollers 270 travel along the first section 196 of the roller overhang areas 194 illustrated in FIG. 7. This is illustrated in dotted outline in FIG. 5. During the second part of the motion, however, the rollers 270 will travel up the flanges 172 and below the second section 198 of the roller overhang areas 194. During this time, the coin tube base 32 will pivot as the stems 254 of the coin tube base 32 rotate in the sockets 272 of the drawer 30. Finally, the rollers reach the third sections 200 of the roller overhang areas 194 as the extended position of the drawer is reached.

Figure 2:
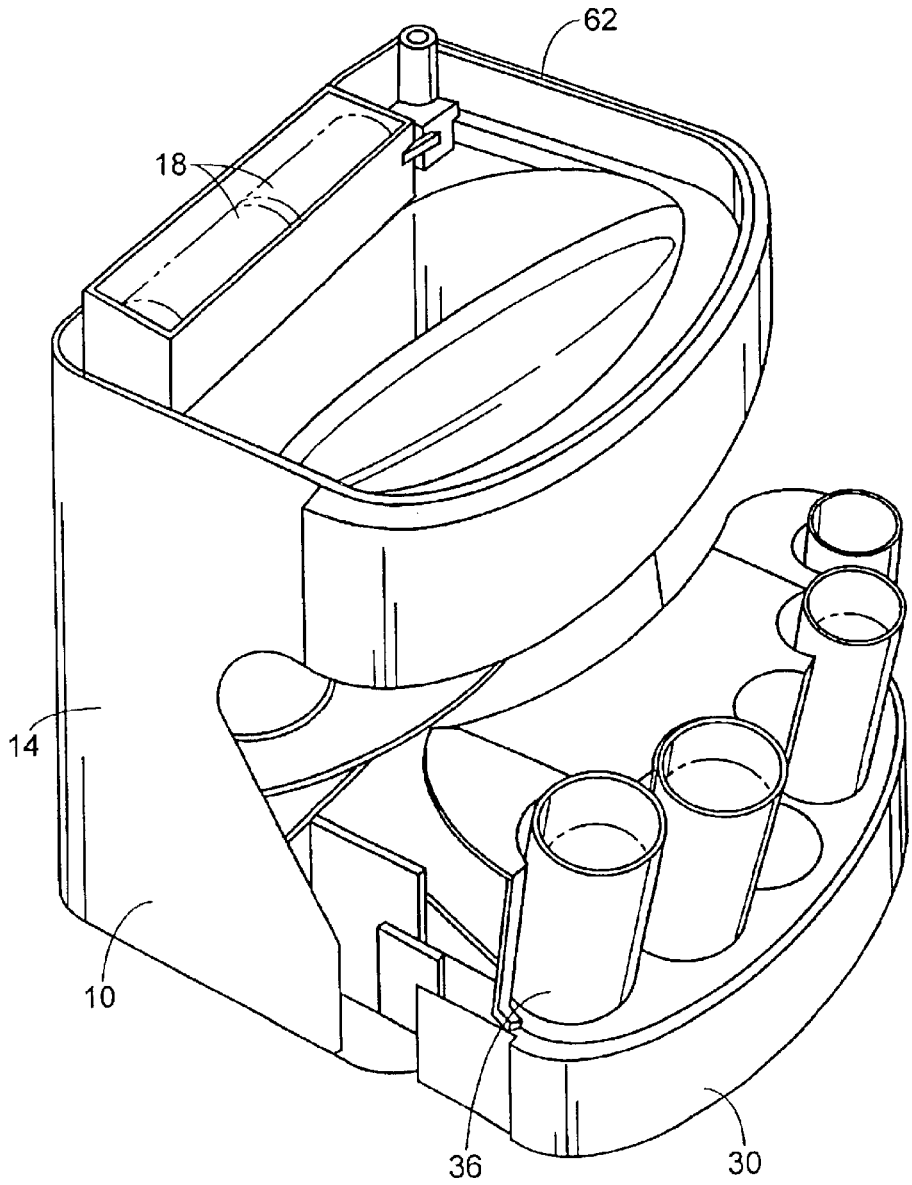
FIG. 2 is an enlarged assembled perspective view of the coin bank of FIG. 1 with a drawer thereof shown in an extended position and with a cover thereof removed.
Figure 3:
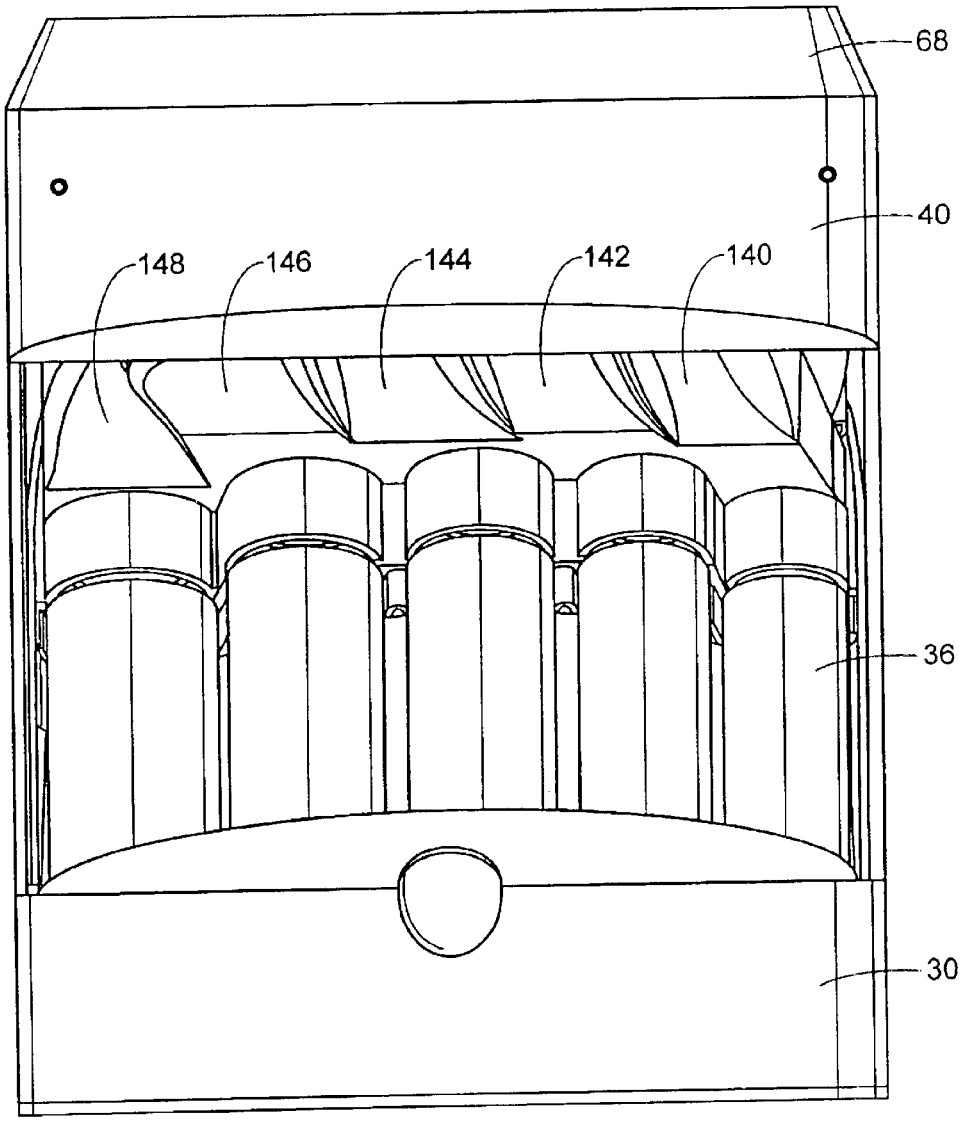
FIG. 3 is a front-elevational view of the coin bank of FIG. 2 with the drawer shown in a retracted position.

At this time, the coin tubes will have reached an approximately upright configuration. In fact, the coin tubes are preferably tilted forward somewhat for ease of removal as illustrated in FIGS. 2 and 6. It should be recognized, however, that the orientation of the coin tubes would not need to change at all if the drawer could be pulled sufficiently far out of the base. The benefit of changing the orientation of the coin tubes is that the distance between the retracted and extended positions of the drawer can be reduced while maintaining ease of removability of the coin tubes. Now, the coin tubes 36 can be removed from the coin tube base 32 and inverted in order to remove the coins held therein.

Figure 13:
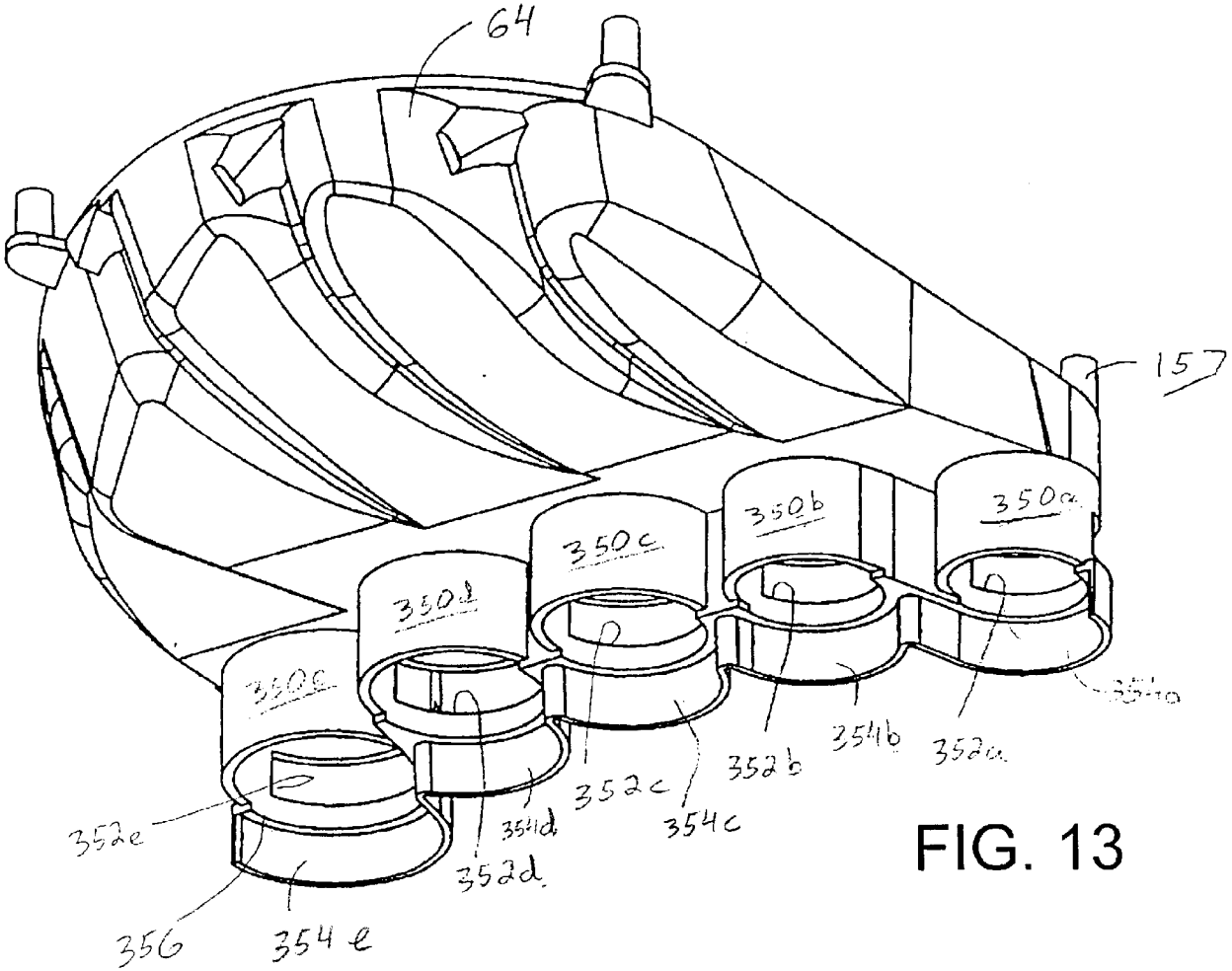
FIG. 13 is a rear perspective view of a coin slide of FIG. 9.
Figure 14:
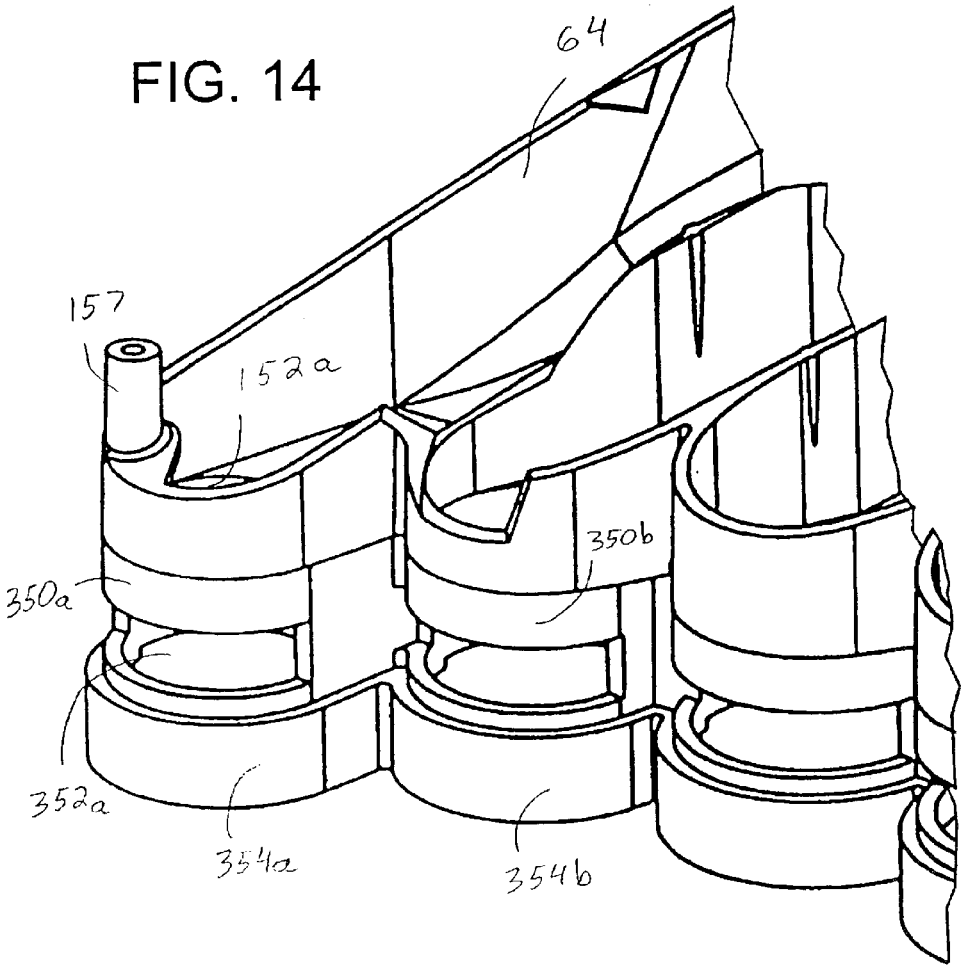
FIG. 14 is an enlarged perspective view from the front right of a portion of the coin slide of FIG. 13.

With reference now to FIG. 13, the coin slide 64 comprises a set of tube sections 350*a*–350*e*, one located beneath each of the apertures 152*a*–152*e*. In this way, coins which fall through the apertures will fall into a respective one of the tube sections 350*a*–350*e*. Positioned in a front wall of each tube section is a respective overflow aperture 352*a*–352*e*. Located beneath the tube sections 350 are respective collar sections 354*a*–354*e*. The collar sections have a somewhat larger diameter than do the tube sections and are spaced forwardly therefrom to define a scalloped abutment wall 356. It is apparent from FIG. 14 that the collar sections 354*a*–354*e* protrude from the tube sections 350*a*–350*e*.

Figure 15:
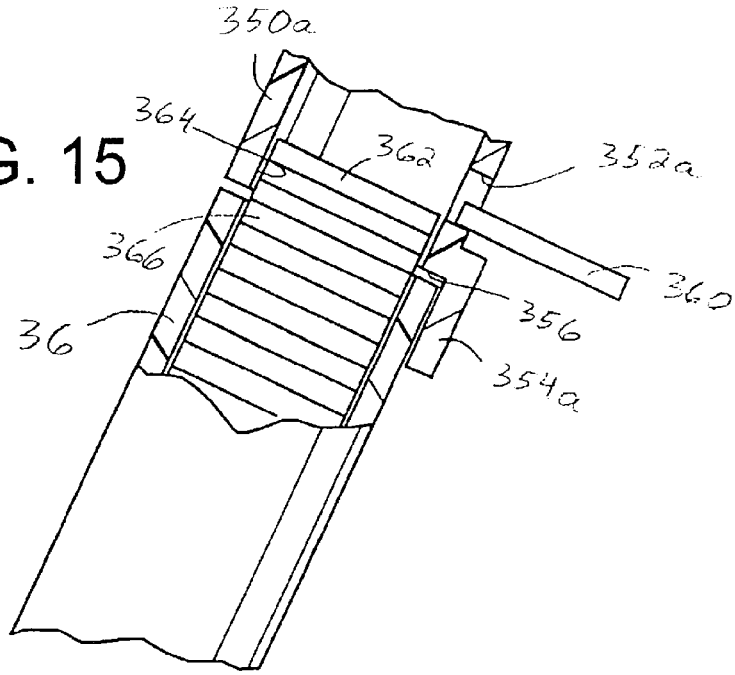
FIG. 15 is a schematic side elevational view illustrating coins overflowing a reservoir positioned above a coin tube of the coin bank and flowing into an overflow area; and, FIG. 16 is a schematic side-elevational view of the coin bank as the drawer is pulled out, thus allowing the overflow coins in the reservoir to flow into the overflow area.

With reference now also to FIG. 15, each tube section 350 overlies a respective one of the tubes 36. To this end, the tube section 350*a*–350*e* are of varying diameters to align with the varying diameter tubes 36 and accommodate coins of differing diameters. The smallest diameter one of the coin tubes 36 and tube sections 350*a* are illustrated in FIG. 15, it being appreciated that the remaining tube section and coin tubes have an identical relationship. When coins have completely filled the coin tube 36, they will accumulate in the tube section 350 until a top-most one of the coins is aligned with the overflow aperture 352*a*. At this point, due to the angle at which the coins are held, the force of gravity will urge an overflow coin 360 to slide out through the overflow aperture 352*a*. This coin will fall into the overflow tray 20 illustrated in FIGS. 1B and 4.

Figure 16:
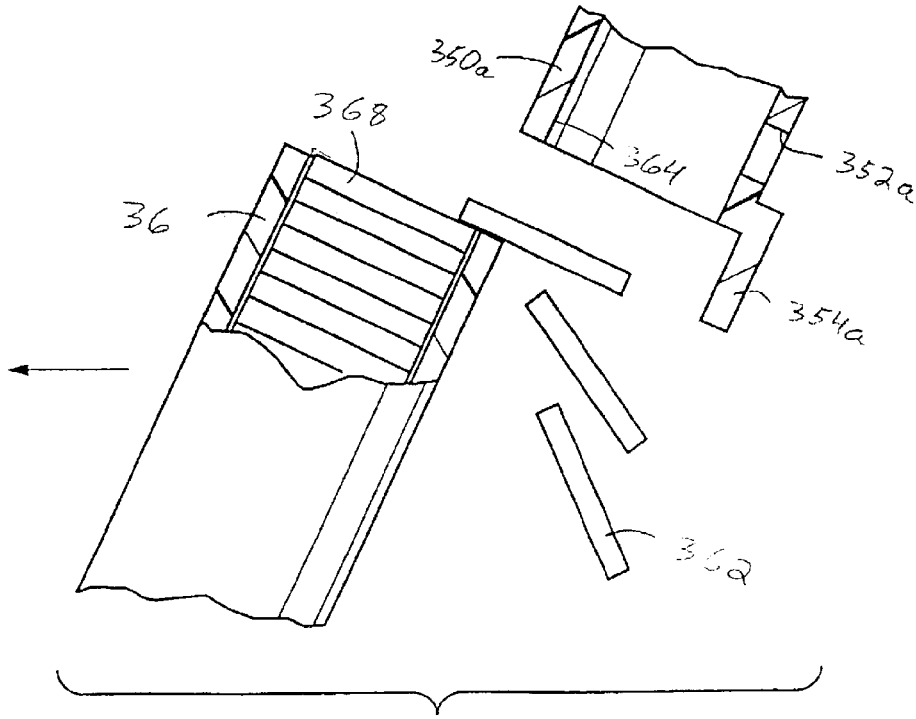

However, several coins, termed reservoir coins 362, are trapped in the tube section 350*a* between an upper edge of the coin tube 36 and the overflow aperture 352*a*. This portion of the coin tube section 350*a* functions as a reservoir 364. The reservoir holds anywhere from one to five, and preferably three, reservoir coins 362. In order for the reservoir to function correctly, the distance between the top edge of the coin tube and the bottom edge of the tube section has to be thinner than the thickness of the coin meant to be accommodated in the coin tube. This relationship is illustrated in FIG. 15. When the drawer 30 is slid forwardly, as illustrated in FIG. 16, the reservoir 364 is emptied and the reservoir coins 362 are allowed to fall out and into the overflow tray 20. However, the coins 368 in the coin tube will remain in place.

The purpose for the reservoir is to stabilize the stack of coins, enable a correct stacking thereof and prevent a skip-off of coins. Moreover, the reservoir allows for a precise count of coins in the coin tube 36. In other words, misalignment of coins in the coin tube 36 is prevented by allowing the stack of coins to build up higher than the top of the coin tube. However, as the coin tubes are moved away from their sorting position, the reservoir 364 is emptied and a coin tube having the exact desired number of coins can be removed from the coin sorter.

The invention has been described with reference to a preferred embodiment. Obviously, modifications and alterations will occur to others upon a reading and understanding of the preceding specification. It is intended that the invention be construed as including all such modifications and alterations insofar as they come within the scope of the appended claims and the equivalents thereof.

What is claimed is:

1. A coin bank comprising:

a housing including a coin receiving area for receiving unsorted coins;

a coin sorting assembly mounted in said housing, wherein said coin sorting assembly comprises a rotating coin separating member, including at least one coin receiving aperture, supported on a housing, including at least one coin sorting aperture, wherein said at least one coin receiving aperture periodically overlies said at least one coin sorting aperture as said coin separating member rotates on said housing;

a drawer slidably mounted in said housing adjacent said coin sorting assembly, said drawer operatively associated with a guide disposed on said housing;

a coin tube support in said drawer; and, a plurality of coin tubes supported on said coin tube support for holding sorted coins.

2. The coin bank of claim 1 further comprising a coin overflow container.

3. The coin bank of claim 1 further comprising a coin slide structure positioned in said housing between said coin sorting assembly and said drawer.

4. The coin bank of claim 3, wherein said coin slide structure includes a plurality of coin slide areas.

5. The coin bank of claim 4, wherein each of said slide areas has an upper end and a lower end, wherein said lower end of each of said slide areas is located adjacent a different one of said plurality of coin tubes.

6. A coin bank adapted to sort coins of at least two different sizes, said coin bank comprising:

a housing having an opening;

a coin sorting assembly having a coin inlet and at least two coin outlets, said coin sorting assembly supported within said housing with said coin inlet operatively associated with said opening of said housing for receiving unsorted coins through said opening;

a drawer moveably supported for reciprocation within said housing approximately beneath said coin sorting assembly on at least one guide;

at least two coin slides supported within said housing between said coin sorting assembly and said drawer, wherein said at least two coin slides are oriented parallel to each other and lie in a common plane; and, at least two corn tubes, each operatively associated with a different one of said coin outlets of said coin sorting assembly, via a respective one of said at least two coin slides, for receiving sorted coins therefrom, said at least two coin tubes being mounted on said drawer.

7. The coin bank of claim 6, wherein each of said coin slides has an upper end and a lower end, and each of said coin slides is supported within said housing such that said upper end thereof is operatively associated with a different one of said coin outlets of said coin sorting assembly.

8. The coin bank of claim 6, Wherein each of said coin slides has an upper end and a lower end, and each of said coin slides is supported within said housing such that said lower end thereof is operatively associated with a different one of said coin tubes.

9. The coin bank of claim 8, wherein said lower end of said coin slides includes a curvilinear wall.

10. The coin bank of claim 6, wherein said at least two coin slides together comprise a unitary coin slide structure.

11. The coin bank of claim 10, wherein said slide structure includes a dividing wall extending between adjacent ones of each of said at least two coin slides.

12. A coin bank adapted to sort a quantity of coins of at least four diameters, said coin bank comprising:

a housing including a coin receiving opening;

a coin sorting assembly having a coin inlet, said coin sorting assembly supported within said housing such that said coin inlet is located adjacent said coin receiving opening of said housing;

a coin slide having an upper end and a lower end supported within said housing such that said upper end thereof is located adjacent a an outlet of said coin sorting assembly;

a drawer slidably supported within said housing and reciprocating between a retracted position and an extended position in relation to said housing; and, a coin tube supported in said drawer at an angle in relation to a horizontal plane, wherein a movement of said drawer between said extended and retracted positions changes the angle of said coin tube in relation to the horizontal plane.

13. The coin bank of claim 12 further comprising an overflow container supported within said housing.

14. The coin bank of claim 12, wherein said housing includes a base portion and a cover portion, and said drawer is supported on said base portion.

15. The coin bank of claim 12, wherein said lower end of said coin slide includes a curvilinear wall.

16. The coin bank of claim 12, wherein said coin tube has an open upper end for receiving sorted coins and partially open lower end in which is positioned a post for supporting a stack of sorted coins.

17. The coin bank of claim 16, wherein said post extends into said coin tube from said coin tube base.

18. The coin bank of claim 12, wherein said coin slide includes a plurality of sections which are separated from each other by walls which together comprise a coin slide structure.

19. The coin bank of claim 18, wherein said housing includes a base portion and a cover portion, and at least one of said coin sorting assembly and said coin slide structure is secured to said upper cover portion.

20. A coin bank comprising:

a housing including a coin receiving area for receiving unsorted coins;

a coin sorting assembly mounted in said housing;

a drawer slidably mounted in said housing adjacent said coin sorting assembly, said drawer being slidably from a retracted position to an extended position in relation to said housing; and, a plurality of sorted coin holders selectively held by said drawer for holding sorted coins, wherein said plurality of sorted coin holders comprises a row of sorted coin holders which are oriented at a common acute angle in relation to a horizontal plane.

21. The coin bank of claim 20 further comprising a coin overflow container.

22. The coin bank of claim 20 wherein each sorted coin holder in said row of sorted coin holders is configured to hold coins of a given maximum diameter.

23. The coin bank of claim 20, wherein said drawer comprises a manually graspable portion.

24. The coin bank of claim 23, wherein said manually graspable portion is located on a front wall of said drawer.

25. The coin bank of claim 20, wherein said drawer and said housing cooperate to define a slide and a guide in order to enable said drawer to be slidably in relation to said housing.

26. The coin bank of claim 1, wherein said guide includes a first cooperating member on said housing and a second cooperating member on said drawer.

27. The coin bank of claim 26, wherein housing includes a bottom wall and said first cooperating member is an elongated rail projecting upwardly from said bottom wall.

28. The coin bank of claim 27, wherein said second cooperating member includes an elongated slot extending along said drawer.

29. The coin bank of claim 20 further comprising a coin overflow area for coins not accommodated in said plurality of sorted coin holders.

30. A coin sorter apparatus comprising:

a housing;

a coin sorting assembly mounted in said housing, wherein said coin sorting assembly comprises:

a coin sorting plate including at least one coin sorting aperture, and a coin carrying member, including at least one coin receiving aperture, said coin carrying member including a circular portion which is rotatably mounted on said coin sorting plate;

a drawer slidably mounted in said housing adjacent said coin sorting assembly, said drawer being slidable from a retracted position to an extended position in relation to said housing; and, a set of sorted coin holders held by said drawer for accommodating associated sorted coins when said drawer is in the retracted position and selectively removable from said drawer when said drawer is in the extended position wherein each coin bolder includes a side wall and a base to define a hollow interior and a post extending from said base into said hollow interior to regulate the number of associated sorted coins held in said coin holder.

* * * * *